United States Patent [19]

Hallcher et al.

[11] 4,293,393

[45] Oct. 6, 1981

[54] USE OF ELECTROGENERATED BASES IN CONDENSATION REACTIONS

[75] Inventors: Richard C. Hallcher, Maryland Heights; Richard D. Goodin, St. Louis, both of Mo.; Manuel M. Baizer, Santa Monica, Calif.

[73] Assignee: Monsanto Company, St. Louis, Mo.

[21] Appl. No.: 113,157

[22] Filed: Jan. 18, 1980

[51] Int. Cl.[3] ..... C25B 3/02; C25B 3/10

[52] U.S. Cl. ..... 204/59 R; 204/72; 204/73 R

[58] Field of Search ..... 204/59 R, 72, 73 R

[56] References Cited

U.S. PATENT DOCUMENTS

| | | | |
|---|---|---|---|
| 3,438,877 | 4/1969 | Baizer | 204/73 R |
| 4,072,583 | 2/1978 | Hallcher et al. | 204/59 R |
| 4,132,611 | 1/1979 | Baizer et al. | 204/59 R |

*Primary Examiner*—F. Edmundson

*Attorney, Agent, or Firm*—L. Bruce Stevens; J. W. Williams, Jr.; J. D. Kennedy

[57] ABSTRACT

The invention is a process for using certain electrogenerated bases in reactions such as acetoacetic ester condensations wherein an azobenzene probase is electro-reduced to produce an electrogenerated base, acetic ester is deprotonated by electrogenerated base to produce an anion, and the anion is condensed with acetic ester to produce acetoacetic ester condensation product; the probase being more easily electro-reducible than the acetic ester and producing an electrogenerated base strong enough to deprotonate the acetic ester which is sufficiently acidic to permit such deprotonation. The probase can be regenerated, either directly or indirectly, by anodic oxidation to probase making the reaction catalytic.

4 Claims, No Drawings

USE OF ELECTROGENERATED BASES IN CONDENSATION REACTIONS

BACKGROUND OF THE INVENTION

This invention relates to a process using certain electro-generated bases in condensation reactions such as acetoacetic ester condensations.

In U.S. Pat. No. 4,132,611, Baizer et al, there is described the use of electrogenerated bases as catalysts for the addition of organic electrophiles to carbon acids, and certain other related prior art is described therein. One of the reactions described in this patent is a condensation reaction illustrated by the condensation of acetaldehyde, column 3, lines 38 through 58.

SUMMARY OF THE INVENTION

The invention is a process using electrogenerated bases in condensation reactions comprising (a) electroreducing an azobenzene probase by electrolysis in an aprotic liquid electrolysis medium comprising the probase, an anhydrous aprotic solvent and a supporting electrolyte to produce an electrogenerated base; (b) deprotonating a compound of the formula

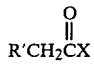

wherein X is a leaving group and R′ is H or hydrocarbyl, with the electrogenerated base to produce an anion of the formula

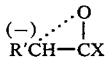

wherein X and R′ are as defined above; and, (c) reacting the anion with a compound of the formula

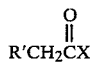

wherein X and R′ are as defined above, to give an anion condensation product of the electrolysis of the formula

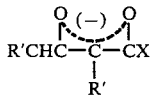

wherein X and R′ are as above; with the aforesaid probase being more easily electro-reducible than the compound to be deprotonated and producing an electrogenerated base strong enough to deprotonate the compound which is sufficiently acidic to permit deprotonation. The reaction can be catalytic with the electrogenerated base after deprotonation being converted, either directly or indirectly, by anodic oxidation to probase. The formulas of the two anions shown above in this paragraph indicate a resonant valence bond which in the first formula is associated with the carbon atom and the oxygen atom connected by the dotted line, and in the second formula the two oxygen atoms and the intermediate carbon atom connected by the dotted line.

The compound to be deprotonated and condensed is of the formula

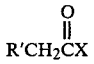

R′ can be H or hydrocarbyl which can be alkyl, alkaryl, aralkyl or aryl, normally not having more than 10 carbon atoms. X is a leaving group and can be OR″, $NR''_2$, halogens (Cl, Br or I), or acyloxy such as

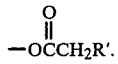

R″ is hydrocarbyl which can be alkyl, aralkyl, alkaryl or aryl, normally not having more than 10 carbon atoms. If the compound to be deprotonated is ethyl acetate having an activating group such as phenyl, e.g. phenyl-2-ethyl acetate, then a weaker base than the hexaisopropylazobenzene anion radical can be used to deprotonate, i.e. the anion radical of 2,2′-di-t-butylazobenzene may be sufficiently basic in this instance.

Typical among the probases which generally satisfy the requirements of the process of the invention, including reoxidation capability, are azobenzenes of the formula

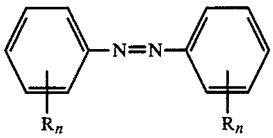

wherein n is at least one and each R is branched-chain alkyl, having from 3 to 6 carbon atoms, e.g. isopropyl, t-butyl, isoamyl, isohexyl and the like, is quite satisfactory for R although longer chain alkyl is also suitable. At least one R on each phenyl ring must be in an ortho position and both ortho positions on each phenyl ring can have R groups. It is preferred that R groups not in ortho position be in para position.

The high basicity of azobenzene anion radicals such as hexa-alkyl azobenzene anion radicals are due to combination of stearic prevention of ring coplanarity by the alkyl groups in the ortho-positions and an electronic effect of multiple alkyl substitution. High basicity can also be accomplished by fewer than alkyl groups in all ortho positions, provided the alkyl groups in the ortho positions are sufficiently bulky to prevent alkylation at nitrogen, and stronger electron-donating substituents are in the para-position (e.g. alkoxy, dialkylamino and the like).

These azobenzenes such as the hexaisopropylazobenzene used in the process of the invention form remarkable basic anion radicals on reduction to the extent that they deprotonate compounds such as ethyl acetate, and the hydrazobenzene produced by deprotonation of the ethyl acetate can be oxidized to the azobenzene by anodically generated bromine permitting catalytic use of the base.

In the solvents employed in the present process, it will generally be desirable to select a solvent (a) which is anhydrous aprotic, (b) which is a weaker acid than the proton donor to be deprotonated, (c) whose liquid range is such that ease of removal of product on work-up is facilitated but loss by evaporation under process conditions is minimized, (d) which is relatively inert under process conditions, and (e) which has a sufficiently high dielectric constant. It will be understood, however, that the choice and concentration of electrolyte can be used to lower electrical resistance. Solvents desirable for use and practice of the present process preferably have low electrophilicity, that is, suitable solvents are substantially non-electrophilic. Further, it is found in practice that it is generally desirable to employ a solvent with a dielectric constant of at least 25, and preferably at least 50. Examples of such anhydrous aprotic solvents include, for example, dimethylformamide, N,N-dimethylacetamide and the like.

Certain salts of alkali metals, amine or quaternary ammonium salts, or mixtures of such can be employed as supporting electrolytes. Among the alkali metal salts useful are lithium, sodium and potassium salts. Among the quaternary ammonium salts useful are the tetraalkylammonium, for example, tetramethylammonium, tetraethylammonium, tetra-n-propylammonium and the like, heterocyclic and alkylarylammonium salts, for example, phenyltriethylammonium and the like, with the tetraalkylammonium salts being generally preferred because of their good solubility and conductivity and because they are difficulty reduced.

Various anions can be used with the foregoing and other cations, for example, halides such as chlorides, bromides, iodides, perchlorates, tetrafluoroborates, hexafluoroborates, sulfonates, tetraphenylborides and the like.

The concentration of the electrolyte salt is not narrowly critical. Thus, for example, suitable concentrations will often be in the range of about 1 percent to about 10 percent by weight of the electrolysis medium or on a molar basis often in the range of about one thousandth to about one molar. The only limitation on the amount of electrolyte salt employed is that the amount is sufficient to promote efficient and economical operation and that it is soluble in the electrolysis medium.

If undivided cells are utilized for carrying out the process of the invention or if regeneration of the probase is carried out in a divided cell, a scavenger is needed which is capable of capturing protons (or water) to produce innocuous scavenger reaction products. Scavengers suitable for the present process are alkali metal carbonates; alkali metal salts of very weak and very insoluble acids, for example, alkali metal tetraborates; basic alumina (which contains alkali metal aluminates, for example, sodium aluminates); acid-type ion exchange resins in the alkali metal form, for example, sulfonic acid-type ion exchange resins in the sodium form, epoxides, for example, 1,2-epoxybutane.

In the present process, either an undivided or a divided electrolysis cell can be employed. A divided cell contains a suitable barrier material or separator which will prevent the free flow of reactants between the cathode and anode. Normally, in the process of the present invention, a divided cell is preferred. It will be appreciated that the electrolysis cells employed in the examples are primarily for laboratory demonstration purposes and production cells are usually designed with a view to the economics of the process. For a general description of various laboratory scale cells, see Lund et al, "Practical Problems in Electrolysis," in Organic Electrochemistry (Baizer, ed) Marcel Dekker, New York, 1973, pp. 165–249, and for some consideration of industrial cell designs, see Danly, "Industrial Electroorganic Chemistry," in ibid, pp. 907–946. The present process is suited to batch, semi-continuous, or continuous operations.

For convenience, temperatures in the range of about 0° to about 100° C. can be used with temperatures between 20° C. and about 55° C. being preferred. The process can be conducted at atmospheric pressure, superatmospheric pressures, and subatmospheric pressures. However, for reasons of economy and ease of construction of equipment employed in the present process, it is preferred to conduct this process at approximately atmospheric pressure.

The following examples indicate the present invention and the manner by which it can be practiced.

EXAMPLE 1

A divided cell having a cathode compartment and an anode compartment separated by a glass frit was employed. The cathode was a mercury pool and the anode was platinum.

Reduction of 2,2',4,4',6,6'-hexaisopropylazobenzene in the presence of ethyl acetate. In a dry box 150 ml of dimethylformamide (DMF) was passed over activated neutral alumina and 5 grams of tetra-n-butylammonium bromide was dissolved in the DMF to make the solvent/electrolyte. The two-compartment divided electrolytic cell was then charged as follows: To the anode compartment-3 grams of 1-hexene and 75 ml of solvent/electrolyte. To the cathode compartment-4 grams of ethyl acetate, 0.434 grams (0.001 moles) of 2,2',4,4',6,6'-hexaisopropylazobenzene and 75 ml of solvent/electrolyte.

The cell was then removed from the dry box, and electrolysis was carried out at −1.8 volts measured against a standard calomel electrode (SCE) on the cathode. Initial current was 60 milliamperes (mA). Anion radical (blue) was observed throughout the electrolysis, and when the current reached 5 mA the electrolysis was stopped (1.72 F/mole of the azobenzene). Five grams of n-butyl bromide was added to the catholyte which was mixed overnight to alkylate the product.

The next day the catholyte was evaporated to dryness heating at 50° C. and 10 mm of mercury pressure. The residue was triturated with ether, the precipitated tetra-n-butylammonium bromide was removed by filtration, and the ether was evaporated. Gas chromatographic (GC) analysis showed a product with the same retention time as

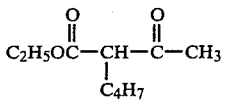

plus the azobenzene and 2,4,6-triisopropylphenylamine, which was probably formed from the hydrazo derivative of the probase. Nuclear magnetic reasonance (nmr) analysis showed 40% current efficiency in formation of the product. The product is the alkylation product of butyl bromide and the product from the electrolysis cell, and the analysis of the alkylated product showed this electrolysis product to be the anion

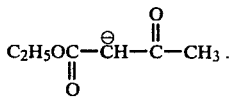

EXAMPLE 2

This experiment shows the self-condensation of ethyl acetate with regeneration of electro-generated base. The same cell as used in Example 1 was used in this experiment.

To the cathode compartment was charged 0.434 grams (0.001 moles) of 2,2',4,4',6,6'-hexaisopropylazobenzene, 7.04 grams (0.08 moles) of ethyl acetate, and 60 ml of 0.1 normal tetra-n-butylammonium bromide in dimethylformamide (DMF). To the anode compartment was charged 0.43 grams (0.001 moles) of 2,2',4,4',6,6'-hexaisopropylhydrazobenzene, 60 ml of the same electrolyte/solvent as charged to the cathode compartment, and 2.5 grams of a basic ion exchange resin capable of scavenging protons.

Electrolysis was carried out at −1.8 volts (measured in the same manner as in Example 1) until the current fell to 8 mA (55,511 counts-theory 54,071), 2.05 faradays/mole of the azobenzene. Anion radical color was observed in the catholyte throughout the electrolysis. The anolyte turned red during the electrolysis indicating the oxidation of hydrazo to azo. Bromine generated at the platinum anode was the oxidizing agent for the hydrazo to azo oxidation.

After completion of electrolysis 6.85 grams of n-butyl bromide was added to the catholyte. The catholyte was evaporated to dryness at 5 mm Hg and 45° C. The residue was triturated with ether, filtered and evaporated to dryness. Gas chromatographic analysis of the reaction mixture after product work-up confirmed the presence of

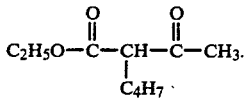

Nuclear magnetic resonance (nmr) analysis indicated a 42% yield of product. The anolyte was evaporated, the residue was triturated with ether, filtered, and evaporated to dryness. Nuclear magnetic resonance analysis showed hexaisopropylazobenzene (85%) and the hydrazo derivative (15%), confirming simultaneous oxidation to hexaisopropylazobenzene.

The use for the electrolysis products of the process of the invention is as intermediates, which can be converted, for example, by alkylation to stable products such as the alkylated acetoacetic ester products of the examples, which are known to be useful as pharmaceutical intermediates and to make flavor and essence fine chemicals.

Although the invention has been described in terms of specified embodiments which are set forth in considerable detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. A process for using electrogenerated bases in condensation reactions comprising (a) electro-reducing an azobenzene probase of the formula

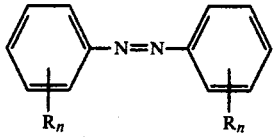

wherein n is at least one, each R is branched-chain alkyl having from 3 to 6 carbon atoms and at least one R on each phenyl ring must be in an ortho position, by electrolysis in an aprotic liquid electrolysis medium comprising said probase, an anhydrous aprotic solvent and supporting electrolyte to produce an electrogenerated base;

(b) deprotonating a compound of the formula

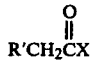

wherein X is OR'', NR''$_2$, Cl, Br, I or

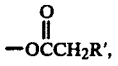

R'' is hydrocarbyl having not more than 10 carbon atoms, and R' is H or hydrocarbyl having not more than 10 carbon atoms, with said electrogenerated base to produce an anion of the formula

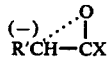

wherein X and R' are as defined hereinabove; and, (c) reacting said anion with a compound of the formula

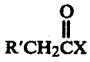

wherein X and R' are as defined hereinabove, to give a condensation product of the electrolysis of the formula

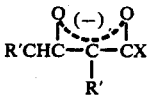

wherein R' and X are as defined hereinabove; the aforesaid probase being more easily electro-reducible than the compound to be deprotonated and producing an electrogenerated base strong enough to deprotonate the compound which is sufficiently acidic to permit deprotonation.

2. A process of claim 1 wherein said probase is hexaisopropylazobenzene.

3. A process of claim 2 wherein X is $OC_2H_5$ and R' is H.

4. A process of claim 2 wherein the reaction is catalytic, with the electrogenerated base after deprotonation being converted by anodic oxidation to probase.

* * * * *